US007442015B2

(12) United States Patent
Oi et al.

(10) Patent No.: US 7,442,015 B2
(45) Date of Patent: Oct. 28, 2008

(54) FUEL FEED APPARATUS WITH REINFORCING STRUCTURE

(75) Inventors: Kiyotoshi Oi, Anjo (JP); Keiichi Yamashita, Kariya (JP); Takanori Ueda, Fuji (JP)

(73) Assignee: Denso Corporation (JP)

( * ) Notice: Subject to any disclaimer, the term of this patent is extended or adjusted under 35 U.S.C. 154(b) by 513 days.

(21) Appl. No.: 10/974,977

(22) Filed: Oct. 28, 2004

(65) Prior Publication Data

US 2005/0095146 A1 May 5, 2005

(30) Foreign Application Priority Data

Oct. 31, 2003 (JP) ..... 2003-372747
Sep. 3, 2004 (JP) ..... 2004-257478

(51) Int. Cl.
*F04B 17/00* (2006.01)

(52) U.S. Cl. ..... 417/423.3; 417/423.14

(58) Field of Classification Search ..... 417/321, 417/423.1, 423.3, 423.14; 415/55.1–55.7, 415/200, 215.1, 9
See application file for complete search history.

(56) References Cited

U.S. PATENT DOCUMENTS 3,111,904 A * 11/1963 Burns ..... 415/123
3,149,574 A * 9/1964 Mill ..... 415/204
3,535,051 A * 10/1970 Turner ..... 415/227
3,829,238 A * 8/1974 Speck ..... 415/197
4,052,133 A * 10/1977 Yeater ..... 415/200
4,451,213 A * 5/1984 Takei et al. ..... 417/366
4,493,620 A * 1/1985 Takei et al. ..... 417/366
4,523,899 A * 6/1985 Ouchi ..... 417/360
4,854,830 A * 8/1989 Kozawa et al. ..... 417/365
4,913,619 A * 4/1990 Haentjens et al. ..... 415/172.1
5,129,796 A * 7/1992 Emmert et al. ..... 417/435
5,551,842 A * 9/1996 Schmid et al. ..... 417/203
6,019,570 A * 2/2000 Talaski ..... 415/55.1
6,068,456 A * 5/2000 Tuckey et al. ..... 417/423.3
6,095,771 A * 8/2000 Schelhas et al. ..... 417/423.14
6,113,363 A * 9/2000 Talaski ..... 417/423.3
6,135,730 A * 10/2000 Yoshioka ..... 417/423.1
6,227,819 B1 * 5/2001 Gettel et al. ..... 417/423.1
6,402,460 B1 * 6/2002 Fischer et al. ..... 415/55.1
6,454,521 B1 * 9/2002 Anderson et al. ..... 415/55.1
6,659,713 B1 * 12/2003 Fujii et al. ..... 415/55.1

(Continued)

FOREIGN PATENT DOCUMENTS

JP 11-168859 6/1999

OTHER PUBLICATIONS

Chinese Examination Report dated May 22, 2006 with partial translation.

*Primary Examiner*—William H Rodriguez
(74) *Attorney, Agent, or Firm*—Nixon & Vanderhye PC

(57) ABSTRACT

A fuel pump is constructed of a pump casing, a rotating member and a reinforcing member. The pump casing internally forms a pump chamber, in which the rotating member is received, such that the rotating member rotates to pressurize fuel in the pump chamber. The reinforcing member reinforces the pump casing against fluidic force applied to the pump casing. The pump casing is formed of resin. The reinforcing member is insert-formed in the pump casing, so that the reinforcing member is at least partially embedded in the pump casing.

12 Claims, 9 Drawing Sheets

U.S. PATENT DOCUMENTS 6,743,001 B2 * 6/2004 Iwanari et al. ..... 417/423.7
6,796,764 B2 * 9/2004 Motojima et al. ..... 415/55.1
6,832,901 B2 * 12/2004 Kuehn et al. ..... 417/423.1
6,932,562 B2 * 8/2005 Ross ..... 415/55.1
7,037,066 B2 * 5/2006 Moss ..... 415/55.1
7,156,610 B2 * 1/2007 Jang et al. ..... 415/55.1
2007/0065314 A1 * 3/2007 Nagata et al. ..... 417/423.1
2007/0086905 A1 * 4/2007 Nagata et al. ..... 417/423.3
2007/0122300 A1 * 5/2007 Sakai et al. ..... 417/423.3
2007/0176511 A1 * 8/2007 Sakai et al. ..... 310/218

* cited by examiner

FUEL FEED APPARATUS WITH REINFORCING STRUCTURE

CROSS REFERENCE TO RELATED APPLICATIONS

This application is based on and incorporates herein by reference Japanese Patent Applications No. 2003-372747 filed on Oct. 31, 2003 and No. 2004-257478 filed on Sep. 3, 2004.

FIELD OF THE INVENTION

The present invention relates to a fuel feed apparatus including a reinforcing structure.

BACKGROUND OF THE INVENTION

A fuel feed apparatus disclosed in JP-A-11-168859 has a rotating member such as an impeller received in a pump casing to pressurize fuel drawn from a fuel tank. The fuel flows through a pump chamber formed in the pump casing, and pressure difference is caused due to pressurization of fuel in the pump chamber. In this situation, fuel pressure, i.e., force applied to the pump casing becomes unbalanced, and pump casing may be deformed when the pump casing does not have enough rigidity. Accordingly, clearance between the pump casing and the rotating member decreases, and rotation of the impeller may be locked in the pump casing. As a result, pumping performance may be decreased.

SUMMARY OF THE INVENTION

In view of the foregoing problems, it is an object of the present invention to produce a fuel feed apparatus having a reinforcing structure to maintain pumping performance.

According to the present invention, a fuel pump includes a pump casing, a rotating member and a reinforcing member. The pump casing defines a pump chamber. The pump casing defines a suction port and a discharge port that respectively communicate with the pump chamber through which fuel passes from the suction port to the discharge port. The rotating member is rotatably received in the pump casing. The rotating member rotates to pressurize fuel in the pump chamber. The reinforcing member reinforces the pump casing against force applied to the pump casing. The pump casing is formed of resin. The reinforcing member is insert-formed in the pump casing, such that the reinforcing member is at least partially embedded in the pump casing.

Alternatively, a molding apparatus for a fuel pump, which includes a resinous pump casing, includes a molding die and a supporting member. The molding die defines a cavity, in which a reinforcing member is insert-molded in the pump casing. The molding die defines a gate, through which resinous material is supplied to mold the pump casing in the molding die. The supporting member is secured to the cavity of the molding die to support the reinforcing member. The reinforcing member defines a hole that is arranged corresponding to the supporting member to be engaged with the supporting member in the molding die. The pump casing has a volumetric portion that substantially axially protrudes from the end face of the pump casing such that the volumetric portion is circumferentially adjacent to the hole. The volumetric portion is arranged on a radially opposite side as the gate with respect to the hole in the molding die.

Alternatively, a molding method of a fuel pump, which includes a resinous pump casing, includes the following steps. A reinforcing member is engaged with a supporting member that is secured to a cavity of the molding die, in which the pump casing is molded, in a manner that a hole defined in the reinforcing member engages with the supporting member. Resinous material is injected into the cavity through a gate defined in the molding die to insert mold the reinforcing member in the pump casing.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENTS

First Embodiment

Figure 1:
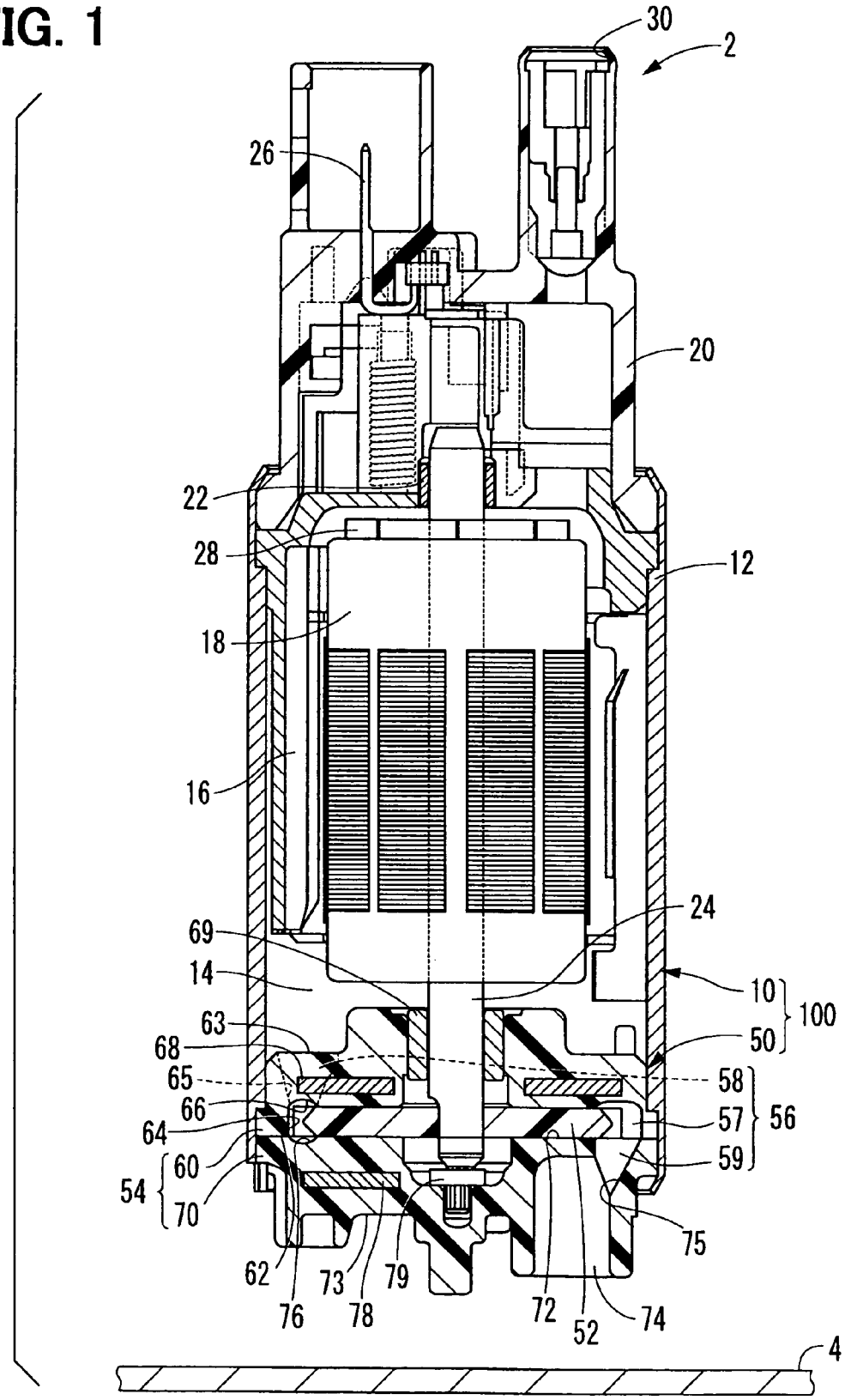
FIG. 1 is a cross-sectional side view showing a fuel feed apparatus according to a first embodiment of the present invention.

As shown in FIG. 1, a fuel pump 2 is received in a fuel tank 4 to supply fuel received in the fuel tank 4 to an engine, so that a fuel feed system such as an electronic fuel injection system is constructed. The fuel pump 2 is an electrically operated pump, and has a motor 10 and a pump 50.

The motor 10 is a DC-motor with a blush. The motor 10 has a structure in which multiple permanent magnets 16 are cylindrically arranged in a motor chamber 14 that is formed in a cylindrical housing 12. An armature 18 is coaxially arranged in the inner circumferential periphery of the cylindrically arranged permanent magnets 16.

A bearing 22 is provided to the axial center of an end cover fixed to one axial end of the housing 12. A shaft 24 of the armature 18 is radially supported by the bearing 22 on one axial end thereof. The armature 18 has multiple coils (not shown), to which electricity is supplied from an external power source via terminals 26, a brush (not shown), and a commutator 28 of the armature 18. The terminals 26 are integrally formed in the end cover 20. The power is supplied to the coils, so that the coils respectively generate magnetic fields to rotate the armature 18 that drives the shaft 24 connected to an impellor 52 received in the pump 50.

The impeller 52 is rotated, so that fuel is pressurized, and the pressurized fuel is introduced to a motor chamber 14. The fuel is discharged from a fuel outlet port 30 formed in the end cover 20 to the outside of the fuel pump 2.

The pump 50 has an internal structure, in which fuel is pressurized in a pump chamber 57 of a pump flow passage 56 formed in a pump casing 54. The fuel is pressurized by the rotating member such as the impeller 52 received in the pump casing 54. The pump casing 54 is constructed of a casing body (outlet member) 60 and a casing cover (inlet member) 70 that are connected with each other at axially opposed ends, and the casing body 60 and a casing cover 70 are fixed to the housing 12 on the axially opposite side as the end cover 20.

The casing body 60 is formed of resin, such that the casing body 60 has a thick disc-shape. The casing body 60 internally forms a discharge port 58 that is an outlet port of the pump chamber 57, from which fuel is introduced out of the pump flow passage 56. The pump chamber 57 is formed among the impeller 52, a sidewall of a circular recess portion 64, and an inner face of a groove 66 located on the bottom face thereof on the upper side in FIG. 1. The sidewall of a circular recess portion 64 opens axially to an end face 62 of the casing body 60. The inner face of a groove 66 has a C-shaped cross-section.

The case body 60 of the pump casing 54 has an axially end face 63, which forms an axially outer wall of the pump casing 54 faced to the motor chamber 14. The discharge port 58 introduces fuel pressurized in the pump chamber 57 to the motor chamber 14.

Figure 2A:
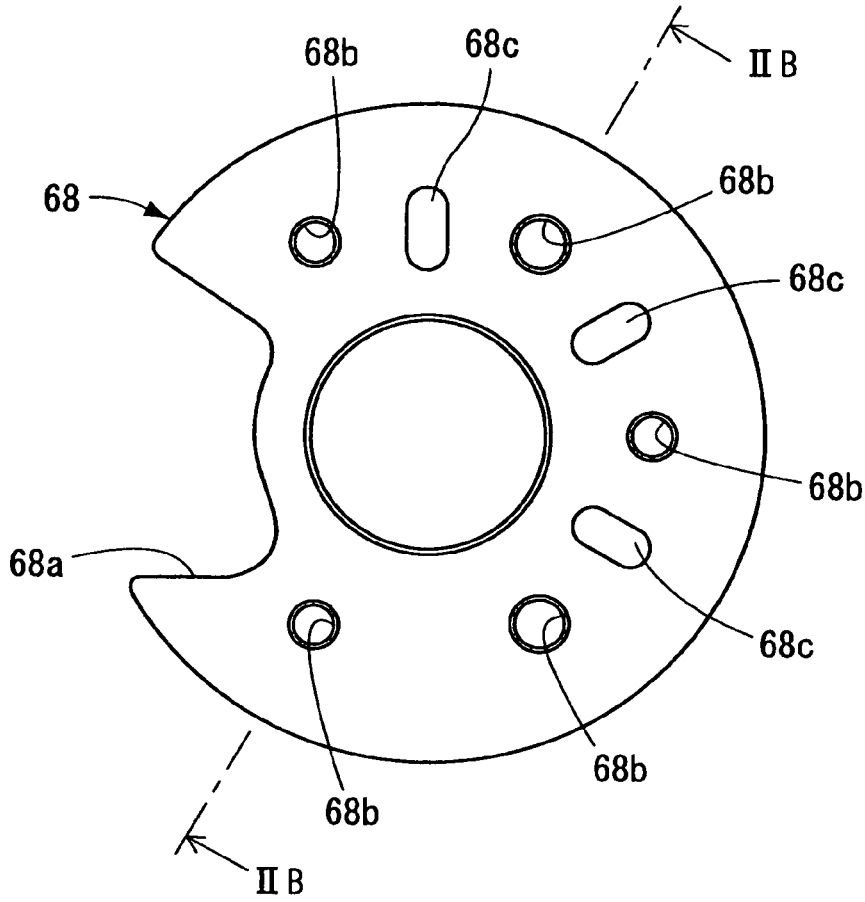
FIG. 2A is a top view showing a reinforcing member.
Figure 2B:
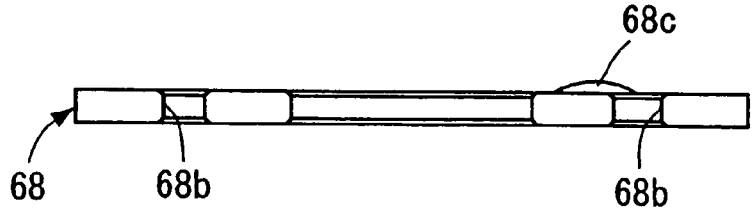
FIG. 2B is a side view showing the reinforcing member along the line IIB-IIB in FIG. 2A according to the first embodiment.

A body side reinforcing member (body-reinforcing member) 68 having a thin plate-shape is insert-formed in the casing body 60, so that the body-reinforcing member 68 is integrally formed at least partially in the casing body 60. The body-reinforcing member 68 is formed of a metal that has rigidity higher than the rigidity of the material forming casing body 60. As shown in FIG. 2, the body-reinforcing member 68 has a substantially annular shape having an opening 68*a*, such that the body-reinforcing member 68 does not disturb fuel flowing through the discharge port 58 of the pump flow passage 56. The body-reinforcing member 68 has multiple holes 68*b* and multiple ribs 68*c* that enhance adherability between the resinous material forming the casing body 60 and the body-reinforcing member 68. Referring back to FIG. 1, the body-reinforcing member 68 is formed in the casing body 60, such that the body-reinforcing member 68 is located between the pump chamber 57 and the motor chamber 14. Thus, the body-reinforcing member 68 reinforces the casing body 60 against fuel force Pp applied to the inner face of the groove 66 in the pump chamber 57 and fuel force Pm applied to the end face 63 in the motor chamber 14.

The casing cover 70 is formed of resin to be in a thick disc shape. The casing cover 70 internally forms a fuel inlet port 74, a suction port 59, and a portion of the pump chamber 57, to which fuel is introduced from the suction port 59. The pump chamber 57 and the suction port 59 partially construct the pump flow passage 56. The fuel inlet port 74 is formed in a bottomed cylindrical shape protruding to the axially opposite side as the casing body 60 with respect to the casing cover 70. The pump chamber 57 includes a C-shaped groove 76 formed in an axially end face 72 of the casing cover 70.

The suction port 59 is formed in the inner periphery of a hole 75 opening to the groove 76 and the fuel inlet port 74. The casing cover 70 forms an axially outer wall of the pump casing 54. The casing cover 70 has an axially end face 73 on the axially opposite side as the casing body 60. The end face 73 of the casing cover 70 axially opposes to the bottom wall of fuel tank 4. Fuel is drawn from the fuel tank 4 to the fuel inlet port 74 through a suction filter (not shown), and the fuel is introduced to the pump chamber 57 through the suction port 59.

The casing cover 70 has a cover side reinforcing member (cover-reinforcing member) 78 having a thin plate shape. The cover-reinforcing member 78 is insert-formed in the casing cover 70. The cover-reinforcing member 78 is formed of a metal that has rigidity higher than rigidity of the material forming the casing cover 70.

The cover-reinforcing member 78 has a shape, such that the cover-reinforcing member 78 does not disturb fuel flowing through the suction port 59 of the pump flow passage 56. The holes and the ribs formed in the body-reinforcing member 68 can be similarly formed in the cover-reinforcing member 78. The cover-reinforcing member 78 is formed in the casing cover 70, such that the cover-reinforcing member 78 is located between the pump chamber 57 and the fuel tank 4. Thus, the cover-reinforcing member 78 reinforces the casing cover 70 against fuel force Pp applied to the inner face of the groove 76 in the pump chamber 57 and fuel force Pt applied to the end face 73 of the casing cover 70 in the fuel tank 4.

The impeller 52 has multiple vanes on the outer circumferential periphery thereof. The impeller 52 is rotatably received in the inner peripheral side of the recess portion 64 of the casing body 60.

The shaft 24 penetrates the radially center of the casing body 60 on the axially opposite side as the end cover 20, and the shaft 24 is coaxially fixed to the impeller 52. The casing body 60 has a bearing 69 in the radially center thereof, and the casing cover 70 has a bearing 79 in the radially center thereof. The axial end of the shaft 24 on the opposite side as the end cover 20 is radially supported by the bearing 69 of the casing body 60, and is axially supported by the bearing 79 of the casing cover 70. The impeller 52 rotates with the shaft 24, such that the impeller 52 slides with respect to the bottom face of the recess portion 64 of the casing body 60 and the axially end face 72 of the casing cover 70. As the impeller 52 rotates, pressure difference is generated between the front side of the vanes of the impeller 52 and the rear side of the vanes of the impeller 52 along the flow direction of fuel due to fluidic friction. The pressure difference is repeatedly generated respectively in the vanes of the impeller 52, so that fuel is pressurized in the pump chamber 57.

Electricity is supplied to the coils of the armature 18, so that the armature 18 is rotated. The impeller 52 fixed to the shaft 24 of the armature 18 is also rotated, so that fuel received in the fuel tank 4 is drawn to the fuel inlet port 74 through the suction filter (not shown). The fuel is introduced to the discharge port 58 of the pump flow passage 56 through the suction port 59 and the pump chamber 57. The fuel passing through the pump chamber 57 is pressurized by the vanes of the impeller 52 in the pump chamber 57 of the fuel pump 2. The pressurized fuel is introduced to the motor chamber 14 through the discharge port 58 of the pump flow passage 56, and the fuel flows to the fuel outlet port 30 through the motor chamber 14. The fuel is discharged from the fuel outlet port 30 to an external device such as the engine.

Pressure difference is caused between fuel pressure Pp in the pump chamber 57 and fuel pressure Pm in the motor chamber 14, when fuel is pressurized by the impeller 52. The casing body 60 receives the fuel pressure Pp on the axially inner face of the groove 66, and receives the fuel pressure Pm on the end face 63. Therefore, fluidic force is applied to the casing body 60, such that the casing body 60 is deformed in an axially opposite direction as the motor chamber 14 to the lower side in FIG. 1 due to pressure difference between the fuel pressures Pp and Pm. However, the casing body 60 is reinforced with the body-reinforcing member 68, so that the casing body 60 can be prevented from deforming due to the fluidic force.

Besides, pressure difference is caused between fuel pressure Pp in the pump chamber 57 and fuel pressure Pt in the fuel tank 4, when fuel is pressurized by the impeller 52. The casing cover 70 receives the fuel pressure Pp on the axially inner face of the groove 76, and receives the fuel pressure Pt on the axially end face 73. Therefore, fluidic force is applied to the casing cover 70, such that the casing cover 70 is deformed to the fuel tank 4 on the lower side in FIG. 1 due to pressure difference between the fuel pressures Pp and Pt. However, the casing cover 70 is reinforced with the cover-reinforcing member 78, so that the casing cover 70 can be prevented from deforming due to the fluidic force.

The reinforcing members 68, 78 respectively prevent the casing body 60 and the casing cover 70 from deforming, even when fuel is pressurized in the pump chamber 57 and pressure difference is caused between fuel inside the pump casing 54 and fuel outside the pump casing 54 in the fuel pump 2. Therefore, the pump casing 54 constructed with the casing body 60 and the casing cover 70 can be prevented from deforming. Accordingly, clearance can be properly maintained among the impeller 52, the bottom face of the recess portion 64 of the casing body 60 and the axially end face 72 of the casing cover 70 that slide with respect to each other. Thus, pumping performance of the fuel pump 2 can be maintained, and the fuel pump 2 can be prevented from causing troubles such as pump lock, in which operation of the fuel pump 2 is stopped due to internal excessive friction, for example.

The reinforcing members 68, 78 are respectively insert-formed in the casing body 60 and the casing cover 70. Therefore, a portion of the pump chamber 57 and the discharge port 58 of the casing body 60 can be formed of resin simultaneously with insert forming, i.e., integrally forming the body-reinforcing member 68 in the casing body 60. Besides, a portion of the pump chamber 57 and the inlet port 59 of the casing cover 70 can be formed of resin simultaneously with insert forming, i.e., integrally forming the cover-reinforcing member 78 in the casing cover 70. Therefore, the casing body 60 and the casing cover 70 constructing the pump casing 54 can be formed simultaneously with arrangement of the reinforcing members 68, 78.

Second Embodiment

Figure 3:
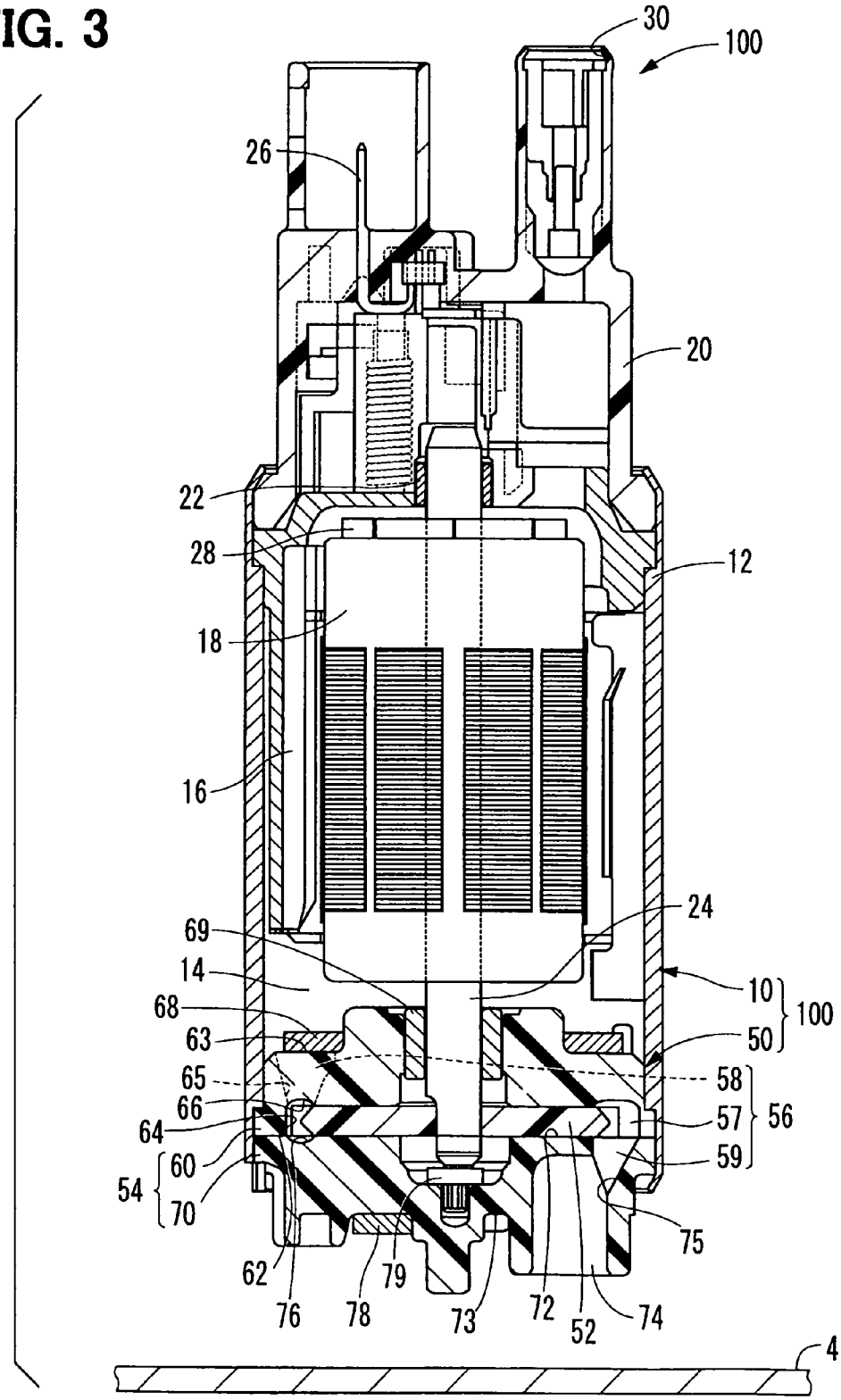
FIG. 3 is a cross-sectional side view showing a fuel feed apparatus according to a second embodiment of the present invention.

As shown in FIG. 3, the body-reinforcing member 68 is provided to the axially end face 63 of the casing body 60 on the side of the motor chamber 14, not to be embedded in the casing body 60, in a fuel pump 100 in this embodiment. Besides, the cover-reinforcing member 78 is provided to the axially end face 73 of the casing cover 70 on he side of the fuel tank 4, not to be embedded in the casing cover 70. The same effects, which is obtained using the reinforce members 68, 78 in the first embodiment, can be also obtained in the structure of the a fuel pump 100 in this embodiment.

Third Embodiment

Figure 4:
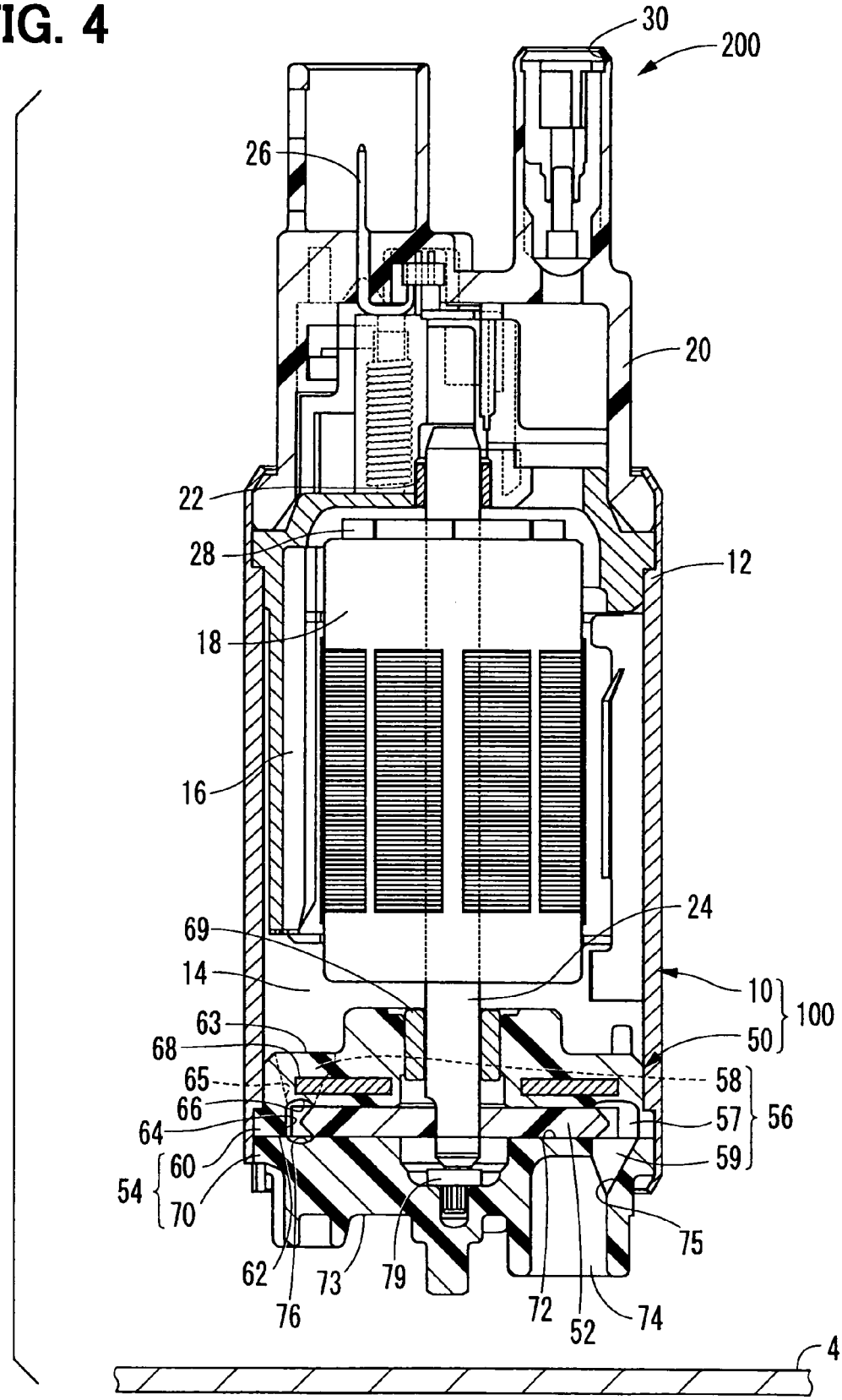
FIG. 4 is a cross-sectional side view showing a fuel feed apparatus according to a third embodiment of the present invention.

As shown in FIG. 4, the cover-reinforcing member 78 is not provided to the casing cover 70 in the fuel pump 200 in this embodiment, and only the body-reinforcing member 68 is provided to the casing body 60 of the pump casing 54. In this structure of the fuel pump 200, the same effect, which is obtained in the first embodiment using the reinforce member 68, can be obtained.

Fourth Embodiment

Figure 5:
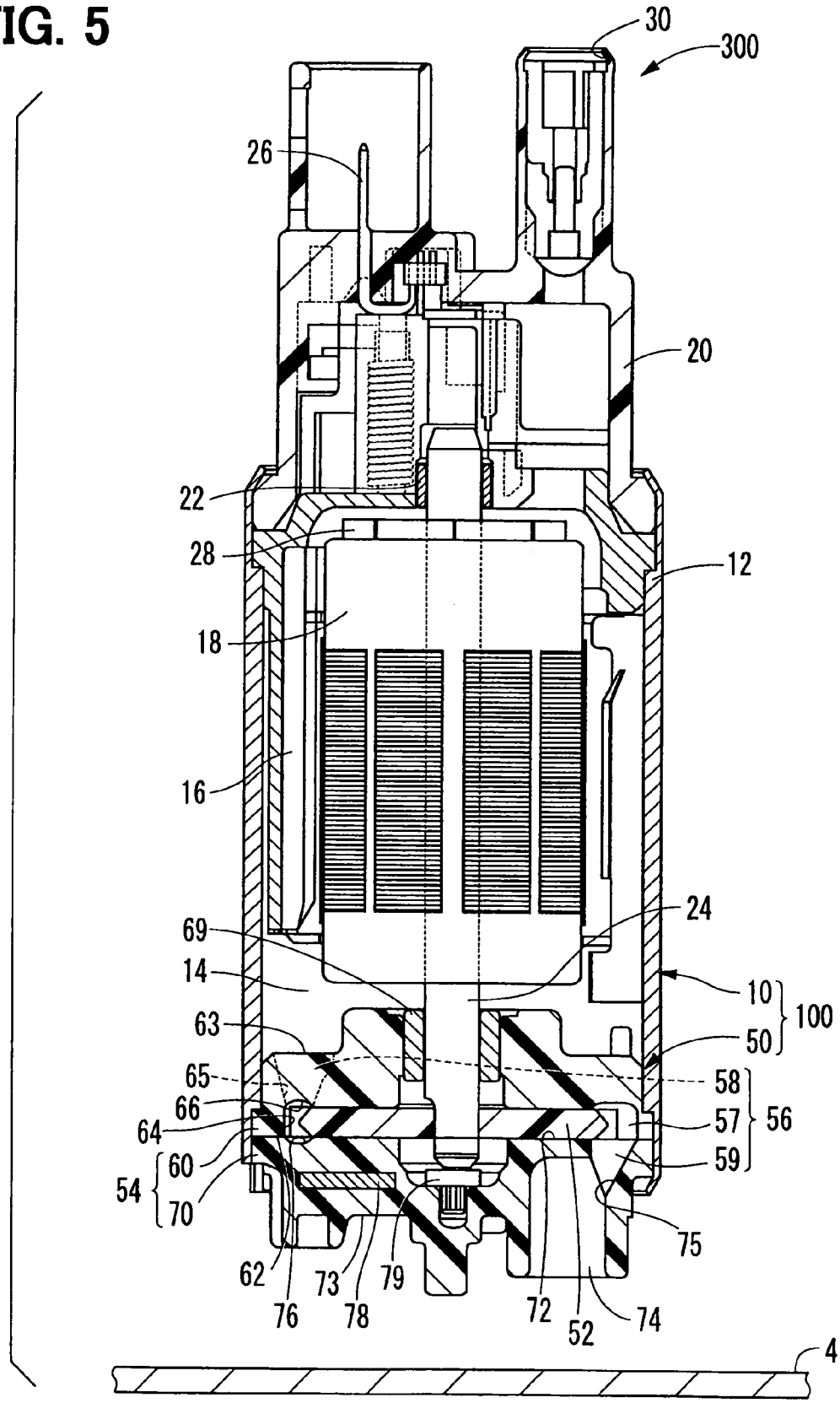
FIG. 5 is a cross-sectional side view showing a fuel feed apparatus according to a fourth embodiment of the present invention.

As shown in FIG. 5, the body-reinforcing member 68 is not provided to the casing body 60 in the fuel pump 200 in this embodiment, and only the cover-reinforcing member 78 is provided to the casing cover 70 of the pump casing 54. In this structure of the fuel pump 200, the same effect, which is obtained in the first embodiment using the reinforce member 78, can be obtained.

Fifth Embodiment

Figure 6:
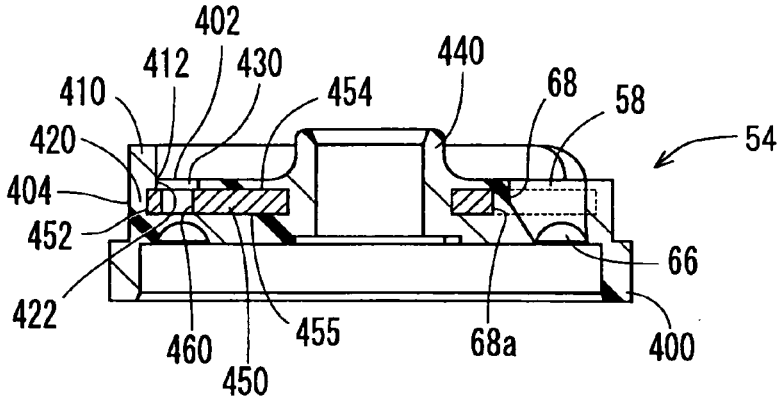
FIG. 6 is a cross-sectional side view showing a casing in which a reinforcing member is insert-formed according to a fifth embodiment of the present invention.
Figure 7:
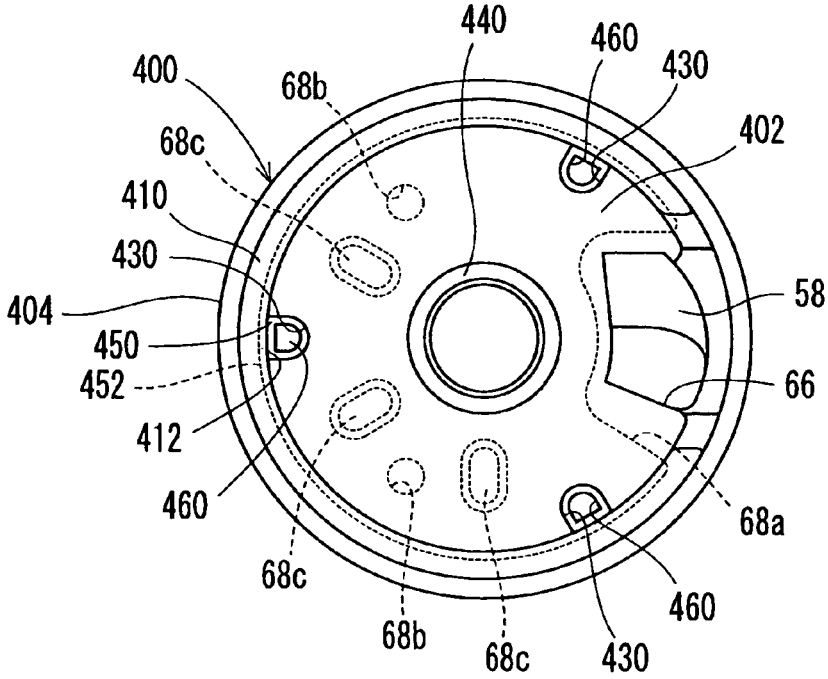
FIG. 7 is a top view showing the casing in which the reinforcing member is insert-formed according to the fifth embodiment.
Figure 8:
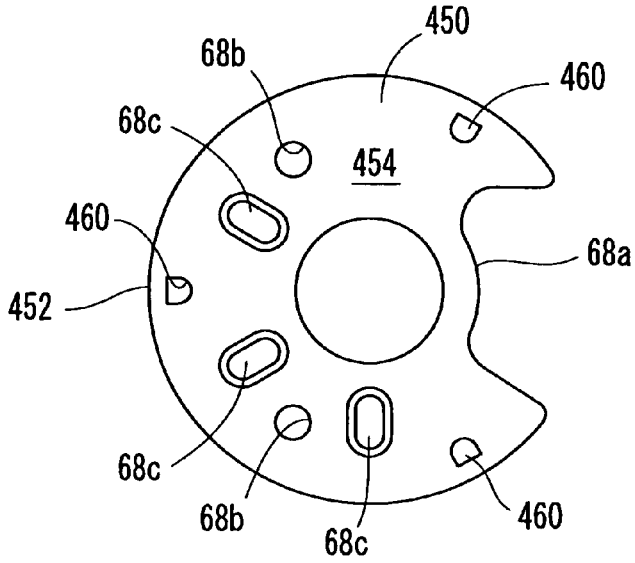
FIG. 8 is a top view showing the reinforcing member according to the fifth embodiment.

As shown in FIGS. 6 to 8, a casing body 400 has a first volumetric portion 410, a second volumetric portion 420 and casing holes 430. A body-reinforcing member 450 is embedded in the casing body 400. The casing body 400 can be combined to the casing cover 70 in the first embodiment to construct the pump casing 54. Alternatively, the casing body 400 can be combined to another of the casing cover 70 such as the casing cover 70, which does not include the cover-reinforcing member 78, in the third embodiment to construct the pump casing 54.

The first volumetric portion 410 is provided along the outer circumferential periphery 404 of the casing body 400. The first volumetric portion 410 substantially perpendicularly protrudes from an end face 402 of the casing body 400 on the axially opposite side as the casing cover 70 (FIG. 1) with respect to the casing body 400. The first volumetric portion 410 is formed in a substantially annular shape that circumferentially extends along the circumferential periphery 404 of the casing body 400. The first volumetric portion 410 has a circumferential length that is less than the circumferential length of the casing body 400. That is, the first volumetric portion 410 does not surround the entire circumference of the casing body 400.

The second volumetric portion 420 constructs the outer circumferential periphery 404 of the casing body 400. The second volumetric portion 420 is provided along the outer circumferential periphery 452 of the body-reinforcing member 450, such that the second volumetric portion 420 substantially perpendicularly protrudes in the opposite direction as the direction, in which the first volumetric portion 410 axially protrudes. Thus, the second volumetric portion 420 entirely surrounds the outer circumferential periphery 452 of the body-reinforcing member 450 in the axial and radial direction thereof. The radial thickness of the second volumetric portion 420 is set to be smaller than the radial thickness of the first volumetric portion 410. The body-reinforcing member 450 slightly intrudes into the second volumetric portion 420 on the opposite side as the direction, in which the first volumetric portion 410 protrudes from the casing body 400. That is, the body-reinforcing member 450 is slightly radially embedded in the bottom portion of the second volumetric portion 420 on the lower side in FIG. 6.

The casing holes 430 are circumferentially arranged in the end face 402 of the casing body 400 in predetermined intervals. In this case, three casing holes 430 are formed in the casing body 400. The casing holes 430 are respectively adjacent radially to an inner circumferential periphery 412 of the first volumetric portion 410 and an inner circumferential periphery 422 of the second volumetric portion 420. Therefore, the first and second volumetric portions 410, 420 are located on the side of the outer circumferential periphery 404 of the casing body 400 with respect to the casing holes 430. Each casing hole 430 is a through hole formed in a substantially semicylindrical cross-sectional shape in a substantially axial direction of the casing body 400. Specifically, the casing hole 430 is formed through the end faces 402, 454 that substantially axially oppose to each other. That is, the casing hole 430 is formed perpendicularly to the end face 402 of the casing body 400 and the end face 454 of the body-reinforcing member 450. The end face 454 of the body-reinforcing member 450 is located substantially axially on the opposite side as the casing cover 40 with respect to the casing body 400.

The body-reinforcing member 450 has holes 460 that respectively substantially correspond to locations, in which the casing holes 430 are formed in the casing body 400. That is, the holes 460 formed in the body-reinforcing member 450 are arranged coaxially with respect to the casing holes 430 formed in the casing body 400. The holes 460 are circumferentially formed in the body-reinforcing member 450 in predetermined intervals. The body-reinforcing member 450 has the substantially same structure as the structure of the body-reinforcing member 68 in the first embodiment excluding the holes 460.

Each hole 460 is formed in a substantially semicylindrical cross-sectional shape that is smaller than the casing hole 430 formed in the casing body 400 in diameter. Specifically, the hole 460 substantially axially penetrates the body-reinforcing member 450 through the end faces 454, 455 that substantially axially oppose to each other, such that the hole 460 is formed through the body-reinforcing member 450 perpendicularly to the end faces 454, 455 of the body-reinforcing member 450.

Next, insert forming method of the casing body 400 including the body-reinforcing member 450 is described.

Figure 9:
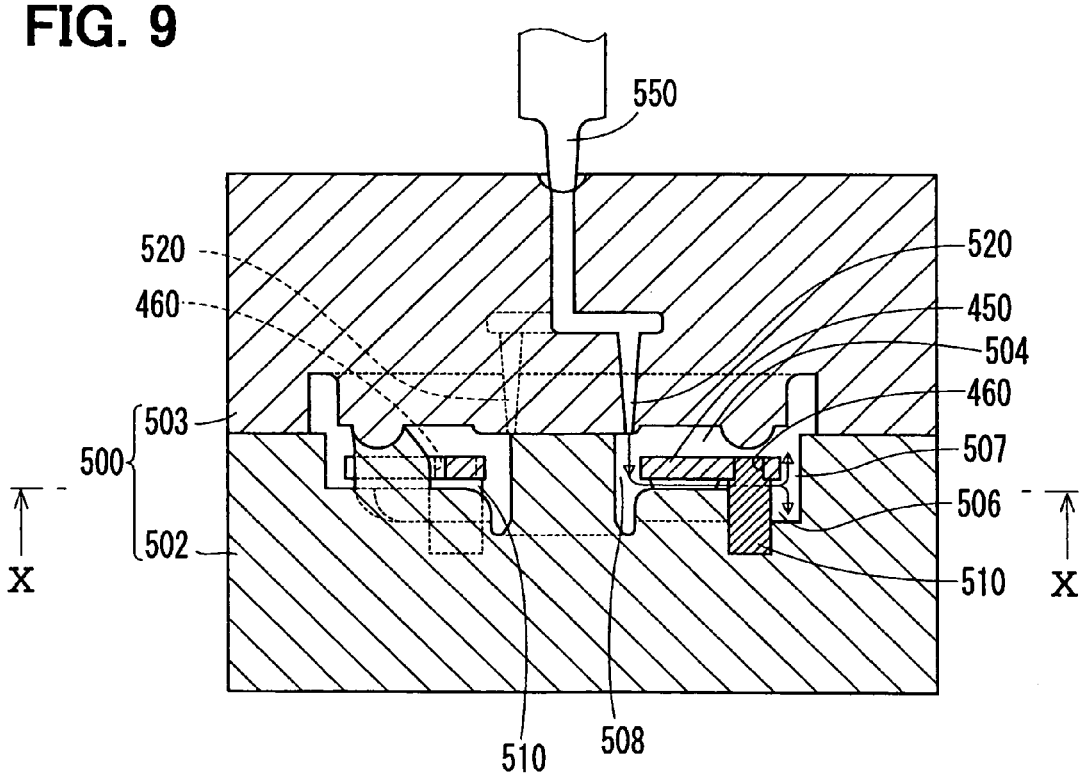
FIG. 9 is a cross-sectional side view showing a forming die receiving the reinforcing member according to the fifth embodiment.
Figure 10:
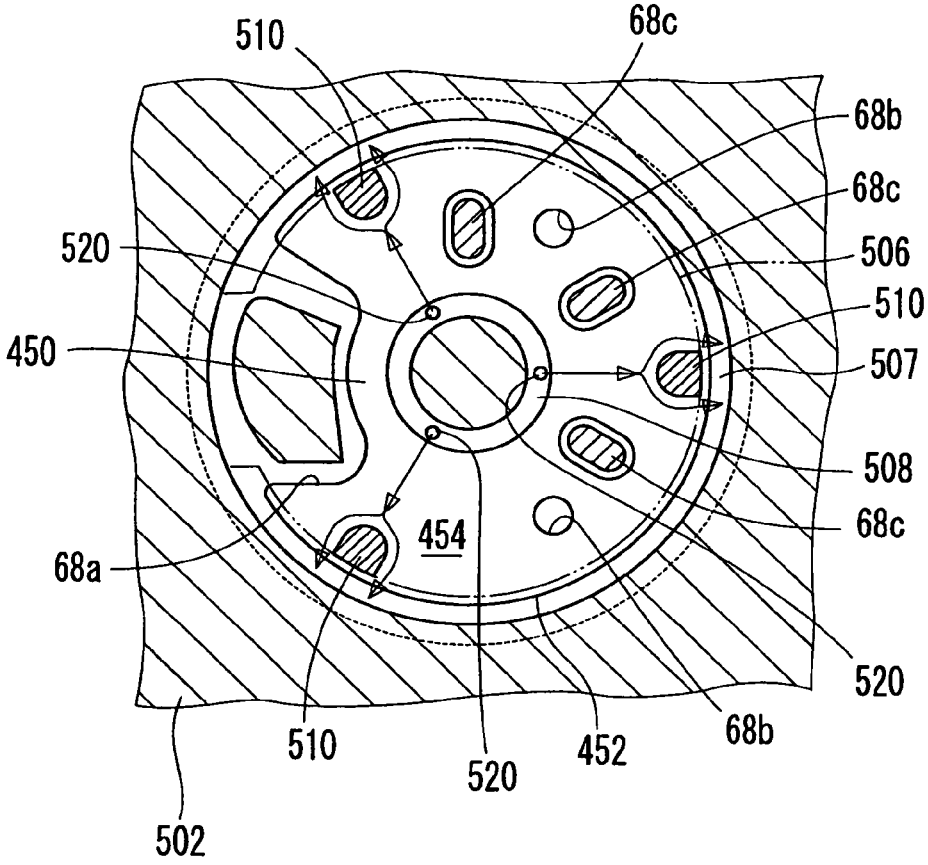
FIG. 10 is a cross-sectional top view showing the forming die along the line X-X in FIG. 9 according to the fifth embodiment.

As shown in FIGS. 9 and 10, molding dies 500 are constructed of die plates 502, 503, such that the die plates 502, 503 are pressed onto each other to internally form a cavity 504 in die matching. The cavity 504 has a first cavity portion 506, a second cavity portion 507 and a central cavity portion 508 for respectively molding the first, second volumetric portions 410, 420 and a central portion 440 of the casing body 400 shown in FIGS. 6 and 7. The molding dies 500 have multiple fixing pins (supporting member) 510, such that the fixing pins 510 are respectively inserted into the hole 460 formed in the body-reinforcing member 450 for steadily supporting the body-reinforcing member 450. The fixing pins 510 are formed in a stepped column shape having a semicylindrical shaped cross-section. The fixing pins 510 can respectively engage with the casing holes 430 formed in the casing body 400 and the holes 460 formed in the body-reinforcing member 450 with substantially no space therebetween. One end portions of the fixing pins 510 respectively engage with the holes 460 formed in the body-reinforcing member 450, and the other end portions of the fixing pins 510 are secured to the die plate 502. The die plate 503 of the molding dies 500 has gates 520, through which resin is supplied entirely to the cavity 504 from the central cavity portion 508 of the cavity 504, in which the central portion 440 of the casing body 400 is formed.

Figure 11:
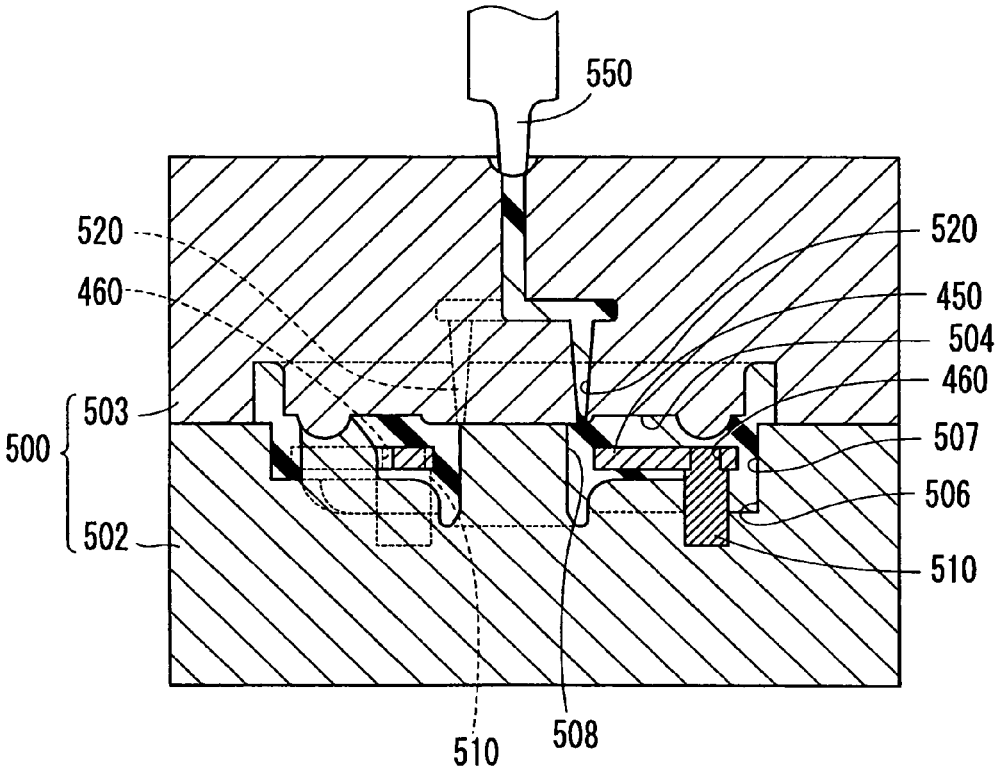
FIG. 11 is a cross-sectional side view showing a forming process using the forming die according to the fifth embodiment.

An injection molding apparatus 550 shown in FIG. 9 supplies molten resin into the cavity 504 through the gates 520, in the insert forming process using the molding dies 500. The molten resin flows through the cavity 504 to the first and second cavity portions 506, 507, in which the volumetric portions 410, 420 are molded. The resinous flow partially collides against the fixing pins 510 before reaching at the first and second cavity portions 506, 507, and the resinous flow is divided into two resinous flows passing along both side faces of an outer periphery 452 of the fixing pins 510 as shown by arrows in FIG. 10. The resinous flows divided by the fixing pins 510 respectively flow to the downstream of the cavity portions 506, 507 as shown by arrows in FIGS. 9, 10, so that the resinous flows surround the outer periphery 452 of the body-reinforcing member 450. The molten resin flows through the cavity 504 to be filled in the cavity 504. Subsequently, the filled molten resin is cooled, so that the molten resin is solidified. As shown in FIG. 11, thus, the casing body 400 is molded, and the body-reinforcing member 450 is embedded in the resin in the cavity 504. The casing holes 430, which respectively engage with the fixing pins 510, are arranged along the outer circumferential periphery of the casing body 400. The molded casing body 400 is taken out of the molding dies 500, after the molding dies 500 is opened and the casing holes 430 are respectively disconnected from the fixing pins 510.

In this embodiment, a large space is formed of the first and second cavity portions 506, 507, in which the first and second volumetric portions 410, 420 are molded, on the downstream side of the fixing pins 510 in the flow direction of the molten resin in the cavity 504 of the molding dies 500. Therefore, resinous flow collides against the fixed pins 510, and the resinous flow is divided into split flows in the insert molding. The resinous split flows respectively enter into the large space, such as the first and second cavity portions 506, 507, so that the split flows are restricted from merging with each other. Thus, the casing body 400 can be restricted from forming a weld portion therein, so that strength of the casing body 400 and the pump casing 54 can be enhanced, in addition to reinforcement using the body-reinforcing member 450. Furthermore, molten resin is supplied over the cavity 504 of the molding dies 500 through the central cavity portion 508, in which the central portion 440 of the casing body 400 is formed. In this molding structure, resinous flow can be substantially radially expanded in the cavity 504, so that resinous flow can be circumferentially substantially uniform. Thus, dimensional accuracy of the molded product such as the casing body 400 can be enhanced.

The body-reinforcing member 68 can be provided in the casing body 60 described in the second embodiment, similarly to the structure in the third embodiment. Alternatively, the cover-reinforcing member 78 can be provided in the casing cover 70 described in the second embodiment, similarly to the structure in the fourth embodiment.

The structures of the casing covers and the cover-reinforcing members described in the first, fourth and fifth embodiments can be formed similarly to the structures of the casing body 400 and the body-reinforcing member 450 described in the fifth embodiment.

The casing body and/or the casing body can be formed of metal. The material forming the reinforcing members is not limited to metal. The reinforcing members can be formed of another material such as resin, as long as the material of the reinforcing member has rigidity higher than the material forming the casing body and the casing cover.

The outer circumferential periphery of the body-reinforcing member can be exposed from the outer circumferential periphery of the casing body, without forming the second volumetric portion in the casing body, in the structure described in the fifth embodiment.

Holes can be formed in the casing body described in the fifth embodiment, such that the holes are arranged on the side of the outer circumferential periphery in the casing body with respect to the first and second volumetric portions, and the holes are arranged to be adjacent to the first and second volumetric portions. In this structure, molten resin can be supplied from a cavity portion, in which the outer circumferential periphery of the casing body is formed, to a central cavity (main cavity) of the molding dies. That is, molten resin can be supplied from the side of the outer circumferential periphery of the casing body to the side of the radially center side of the casing body, so that the body-reinforcing member can be embedded in the casing body, i.e., insert molded in the casing body. In this molding structure, molten resin can be injected into a large space formed in the central cavity, so that welding portion can be restricted from being formed in the casing body similarly to the fifth embodiment. Conventionally, a cavity space formed on the downstream side of the resinous flow with respect to the supporting member (510) is not considered in general. Therefore, resinous flow may be merged on the downstream side of the resinous flow due to collision against the supporting member (510) and flowing into a narrow cavity space, when the cavity space on the downstream side is insufficient in the forming die. The merge of the resinous flow may form a weld point that degrades rigidity of the pump casing. However, in the structure of the molding dies described above, sufficient cavity space can be formed on the downstream side of the resinous flow with respect to the fixing pins. Therefore, welding portion can be restricted from being formed in the casing body molded in the molding cavity.

The reinforcing structure and the manufacturing method of the components of the fuel pump can be applied to another apparatus, such as a trochoid pump that has a pump casing receiving a trochoid gear.

Various modifications and alternations may be diversely made to the above embodiments without departing from the spirit of the present invention.

What is claimed is:

1. A fuel pump comprising:

a pump casing that defines a pump chamber, the pump casing defining a suction port and a discharge port respectively communicating with the pump chamber through which fuel passes from the suction port to the discharge port;

a rotating member that is rotatably received in the pump casing, the rotating member rotating to pressurize fuel in the pump chamber; and a reinforcing member that reinforces the pump casing against force applied to the pump casing, wherein the pump casing is formed of resin, the reinforcing member is entirely embedded in and encapsulated by the pump casing, and the reinforcing member is not directly facing the pumping chamber, so as to be isolated from the rotating member.

2. The fuel pump according to claim 1, wherein the reinforcing member is insert-formed in the pump casing.

3. The fuel pump according to claim 2, wherein the pump casing has a volumetric portion that substantially axially protrudes from an outer circumferential periphery of an end face of the pump casing.

4. The fuel pump according to claim 3, wherein the volumetric portion of the pump casing includes a first volumetric portion and a second volumetric portion, the first volumetric portion protrudes in a substantially axial direction of the pump casing, the second volumetric portion substantially axially protrudes in a substantially opposite direction as a direction in which the first volumetric portion protrudes, and the second volumetric portion is axially adjacent to the first volumetric portion.

5. The fuel pump according to claim 3, wherein the pump casing defines a hole in an end face of the pump casing, and the volumetric portion is substantially circumferentially adjacent to the hole.

6. The fuel pump according to claim 1, further comprising:

a motor that rotates the rotating member, wherein the motor defines a motor chamber through which fuel, which is pressurized by the rotating member, passes from the discharge port of the pump chamber to a fuel outlet port that communicates with the motor chamber, the pump casing axially opposes to the motor chamber, and the reinforcing member is arranged between the pump chamber and the motor chamber.

7. The fuel pump according to claim 6, wherein the pump casing includes an inlet member and an outlet member, the inlet member defines the suction port communicating with the pump chamber, the outlet member defines the discharge port communicating with the pump chamber, and the reinforcing member is arranged between the pump chamber and the motor chamber to reinforce the outlet member.

8. The fuel pump according to claim 1, further comprising:

a housing that surrounds a circumferential periphery of the pump casing.

9. The fuel pump according to claim 1, wherein the reinforcing member is axially opposed to the rotating member via at least a part of the pump housing.

10. The fuel pump according to claim 1, wherein the reinforcing member is located further away from the rotating member than the pump housing.

11. A fuel pump comprising:

a pump casing that defines a pump chamber, the pump casing defining a suction port and a discharge port respectively communicating with the pump chamber through which fuel passes from the suction port to the discharge port;

a rotating member that is rotatably received in the pump casing, the rotating member rotating to pressurize fuel in the pump chamber; and a reinforcing member that reinforces the pump casing against force applied to the pump casing, wherein the pump casing is formed of resin, the reinforcing member is at least partially embedded in the pump casing, the reinforcing member is not directly facing the pumping chamber, so as to be isolated from the rotating member, the pump casing substantially axially opposes to a fuel tank, and the reinforcing member is arranged between the pump chamber and the fuel tank.

12. The fuel pump according to claim 11, wherein the pump casing includes an inlet member and an outlet member, the inlet member defines the suction port communicating with the pump chamber, the outlet member defines the discharge port communicating with the pump chamber, and the reinforcing member is arranged between the pump chamber and the fuel tank to reinforce the inlet member.

* * * * *